US005587697A

United States Patent [19]

Rent

[11] Patent Number: 5,587,697

[45] Date of Patent: Dec. 24, 1996

[54] CHIME ALARM APPARATUS

[76] Inventor: Michael P. Rent, Box 287, Bridgetown, N.S., B0S 1C0, Canada

[21] Appl. No.: 350,103

[22] Filed: Nov. 29, 1994

[51] Int. Cl.[6] ..... G08B 3/00; G10K 1/00

[52] U.S. Cl. ..... 340/392.4; 340/392.1; 340/392.5; 116/141

[58] Field of Search ..... 340/392.4, 392.1, 340/392.5, 398.1; 116/141; 84/402, 404, 600; 368/273

[56] References Cited

U.S. PATENT DOCUMENTS

| | | | |
|---|---|---|---|
| 2,270,085 | 1/1942 | Schwinzer | 340/392.5 |
| 2,506,009 | 5/1950 | Bergeron | 340/392.5 |
| 3,774,191 | 11/1973 | Enemark | 340/563 |
| 4,967,633 | 11/1990 | Jewell, Jr. | 84/404 |
| 5,072,208 | 12/1991 | Christensen | 340/392 |
| 5,208,578 | 5/1993 | Tury et al. | 340/393 |

*Primary Examiner*—Donnie L. Crosland
*Attorney, Agent, or Firm*—Dressler, Goldsmith, Milnamow & Katz, Ltd.

[57] ABSTRACT

A chime alarm apparatus having a housing having an axis and adapted to be suspended from rigid support. A first elongate annular member having upper and lower ends is suspended at its upper end from the housing and is substantially coaxial therewith, whereby the member may swing laterally relative to the housing. A disc-shaped contact member is supported by the first elongate member intermediate the ends thereof and the lower end of the first elongate member includes a pendant whereby the first elongate member may be caused to move laterally by an external force contacting the pendant. A plurality of second elongate members are suspended from the housing peripherally outwardly of and spaced a selected distance from the first elongate member and the contact member. Each second member has an area of contact between its ends, the pendant being normally below the lower ends of the second members. The disc-shaped contact member and the second members are of a material whereby a chime sound is produced when the contact member moves laterally and contacts the area of contact of at least one of the second members. An electric circuit includes a source of power, the contact member, at least each area of contact of the second members and alarm, whereby when the contact member contacts an area of contact of at least one second member, the electric circuit is closed and the alarm in the electric circuit is activated.

6 Claims, 5 Drawing Sheets

CHIME ALARM APPARATUS

FIELD OF INVENTION

This invention relates to an alarm system and more particularly to an alarm system in the form of door chimes.

BACKGROUND OF THE INVENTION

Door chimes have been known for some time and are frequently used by homeowners as well as storekeepers. Storekeepers have used door chimes, not only for the pleasant sounds they can provide, but also to alert personnel in the store that someone has entered the store.

U.S. Pat. No. 5,208,578, May 4, 1993 by Tury et al relates to a light powered chime for indoor use where light falling on solar cells activates the striker in a random manner.

Similarly, U.S. Pat. No. 5,072,208, Dec. 10, 1991 by Christensen relates to an electromechanical chaotic chiming mechanism wherein a chime hammer is driven by an electromagnet and variations in the drive vary the pattern of sound produced by the chimes.

U.S. Pat. No. 2,270,085, Jan. 13, 1942 to Schwinzer relates to a chime signal device and more particularly to a device for creating an audible signal in the form of musical sounds upon activating a button.

However, none of these patents disclose a chime alarm device as contemplated by my invention.

Further, some of the personnel in a store or residence may be auditorially impaired or the door may be opened sufficiently slowly that a person some distance from the door may not clearly hear the chimes. This may particularly be so if the storekeeper is in a back room or washroom, even momentarily.

Although it may not be as prevalent in the metropolitan areas as in the country, often country people will leave their doors unlocked and it is not unexpected to have neighbours come in. Chimes are useful to alert occupants that someone has entered, even a friend.

The sound provided by the door chime may be temporary, particularly if the door is opened slowly and it would be beneficial if the noise or alarm aspects of the chime were extended or visibly provided for as well as audibly provided for.

Unfortunately there are more and more unwanted intrusions into stores and residences off hours and it would also therefore be beneficial to have a chime device which can provide an alarm noise or signal under such circumstances.

Accordingly, I believe there is a need for a door chime which provides further alarm information, whether in the vicinity of the door chime, remotely, or both.

SUMMARY OF THE INVENTION

The invention provides a door chime which is constructed so that it is part of an electrical circuit which activates a buzzer alarm and/or a flashing light.

The invention in one broad aspect provides chime alarm apparatus comprising a housing which may be suspended from a fixed surface such as the ceiling or from a wall supported bracket. A first elongate member has upper and lower ends, the upper end being suspended from substantially the center of the bottom of the housing in such manner that it can swing laterally. A disc-shaped contact member is connected to the first member intermediate its ends with the lower end of the first member having a pendant element associated therewith whereby the first member is caused to move laterally when an external force contacts the pendant. A plurality of second elongate members are suspended from the housing peripherally outwardly of and spaced a selected distance from the contact member associated with the first member, each second member having an area of contact for the contact member between its ends. The lower end of the pendant is normally below the lower ends of the second members. The contact member and the second members are of a material wherein a chime sound is produced when the contact member contacts the area of contact of at least one of the second members. An electric circuit includes a source of power, the contact member and at least each area of contact of the second members whereby when the contact member contacts the area of contact of at least one second member, the electric circuit is closed. Alarm means within the electric circuit is activated by closure of the circuit.

DESCRIPTION OF THE PREFERRED EMBODIMENTS

Figure 1:
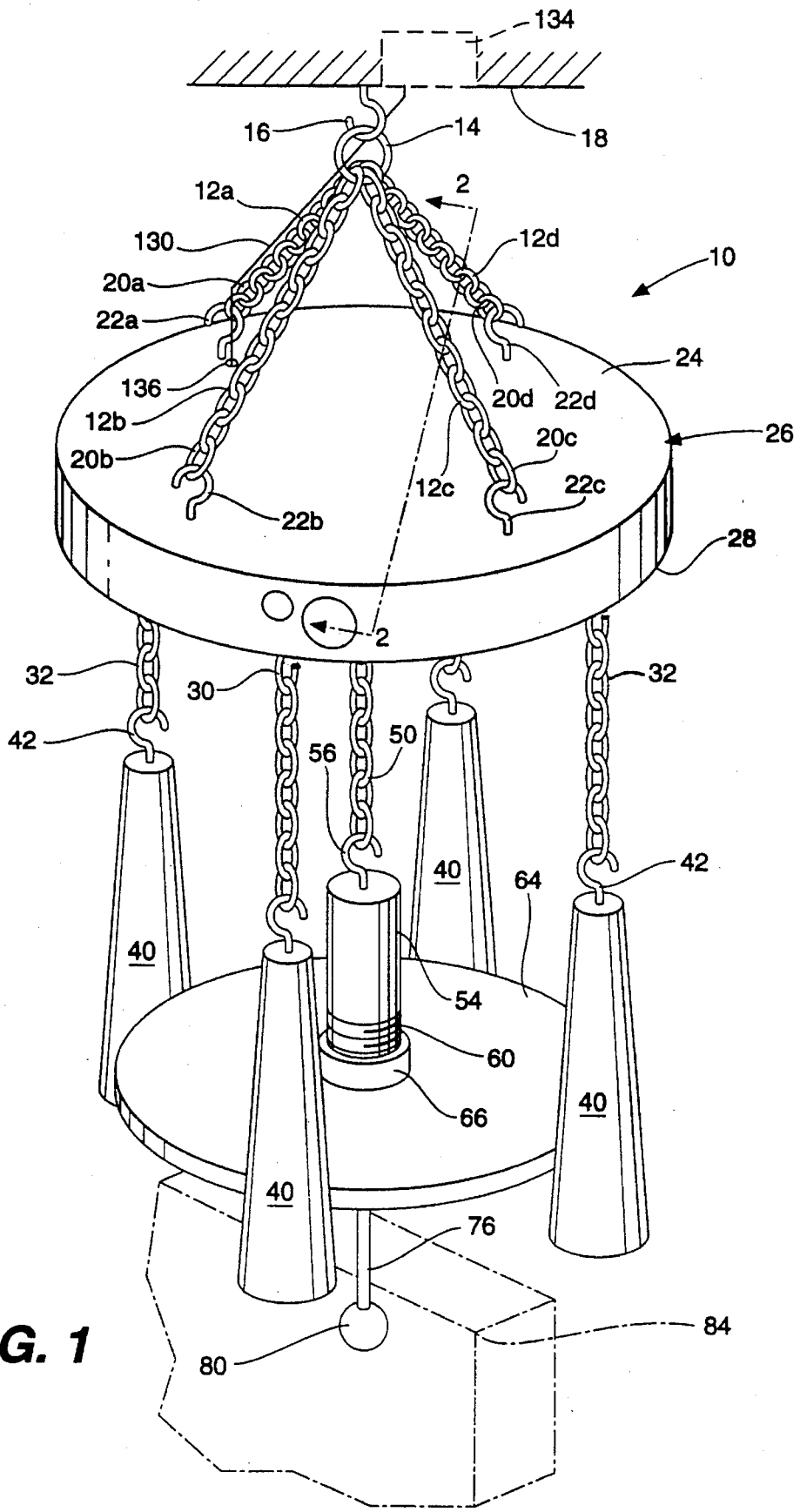
FIG. 1 is a perspective view of a preferred embodiment of my inventive chime alarm apparatus.
Figure 2:
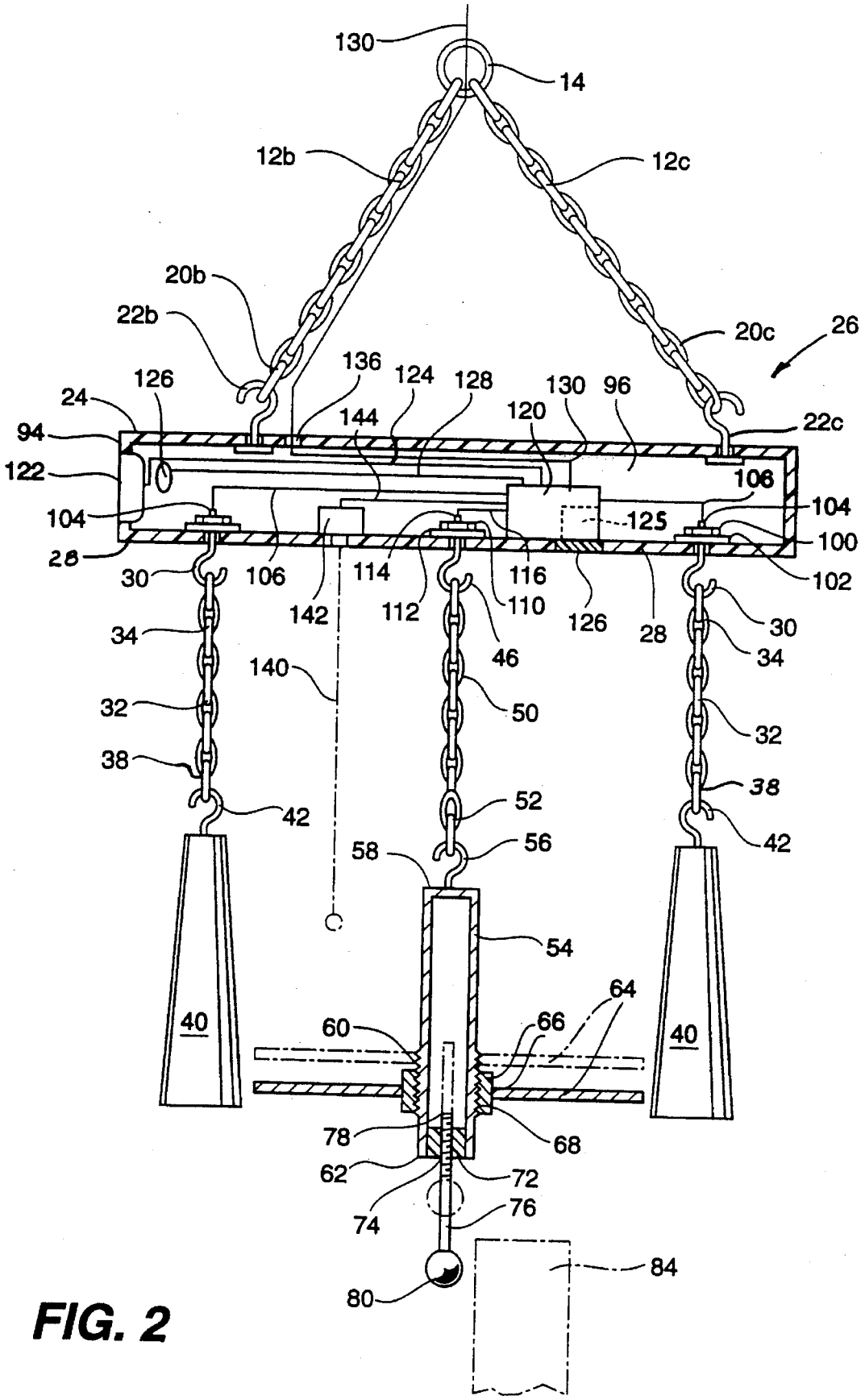
FIG. 2 is a sectional view of the apparatus taken along line 2—2 of FIG. 1.

A perspective view of one preferred embodiment of the chime system of my invention is shown in FIGS. 1 and 2 wherein the chime alarm device 10 has chains 12*a–d*, the upper ends of each thereof connected to ring 14 which is adapted to cooperate with hook 16 for hanging the device 10 from a ceiling 18, hook device 16 being screwed into or otherwise secured to ceiling 18. It will be appreciated that the device 10 could equally be hung from an appropriate wall bracket (not shown in FIGS. 1 and 2).

The lower ends 20*a–d* of chains 12*a–d* are connected respectively to hooks 22*a–d* which are secured to top 24 of support housing 26, housing 26 being in the form of a cylindrical disc and having bottom 28. Peripherally spaced hooks 30 (four being shown) are secured to and extend from bottom 28 of housing 26, each hook 30 being of electrically conductive material. Electrically conductive chains 32 each has an upper end 34 associated with a respective hook 30 and a lower end 38 which is connected to a chime tube 40 through hook 42 secured to the upper end of each chime tube 40. Although shown of equal length, the length of the chime tubes 40 may be different in order to provide for a pleasant variation in sound. Chime tubes 40 are shown slightly conical in configuration for reasons further described herein.

Hook 46 extends from the center of bottom 28 of disc-shaped support housing 26 and supports electrically conductive chain 50, the lower end 52 of which supports conductive center hollow tube 54 through hook 56 secured to the upper end 58 of tube 54. Tube 54 has a threaded exterior portion 60 intermediate its upper end 58 and lower end 62. Thin electrically conductive contact disc 64 has boss 66 with internal threads 68 for threaded engagement with threaded portion 60 of tube 54. Lower end 62 of tube 54 extends below the plane of disc 60 and has a nonconductive plug 72 with threaded bore 74. Tubular striker 76 has shank upper end 78 threadedly secured in bore 74 and has non-conductive bulbous lower pendant 80 which is of suitable material to contact a door 84 or the like, without marring the surface of the door. If desired, a striker plate, (not shown), of suitable material can be secured to door 84 to lessen contact marks which could mar the finish of the door and/or to reduce the sound of contact.

FIG. 2 shows an enlarged partial sectional view of support housing 26, hollow tube 54, disc 64 and striker 76. The threaded connection (60, 66) between disc 64 and tube 54 enables disc 64 to be longitudinally displaced relative to tube 54. It will be apparent that by rotating disc 64, resulting in the disc moving upwardly or downwardly relative to tube 54, the sensitivity of the alarm chime may be adjusted. The closer the disc is to lower end 62 of tube 54, the less is the gap between the periphery of disc 64 and conical chime tubes 40 and therefore the less is the movement required of pendant 80 relative to the chimes 40 to activate the chime alarm apparatus.

Further, the threaded connection between striker end 78 and bore 74 of tube plug 72 enables striker 76 to be raised manually above the line of the door, to a position shown in dotted lines in FIG. 2), to selectively deactivate the chime and alarm, the striker pendant 80 then being above the top edge of door 84.

As more particularly shown in FIG. 2, disc-shaped housing 26 comprises upper, lower and circumferential walls 24, 28 and 94 which define a housing interior 96 containing electrical circuitry to activate the alarm system, as well as to support the various hooks 30 and 46.

Housing 26 may be constructed of plastic material but a metal housing, wherein the electrical circuitry is suitably insulated therefrom as required, is also contemplated.

Hooks 30, only two of which are shown in FIG. 2, are each supported by nut 100 on washer 102, the threaded end 104 of hook 30 being in an electrical circuit through wire 106. Similarly hook 46 is supported by nut 110 on washer 112 and threaded hook end 114 is in an electrical circuit through wire 116. As previously noted, the various chains 30, chime tubes 40, tube 54 and disc 64 are of suitable material to be in an electrical circuit, the gap between the disc and chimes acting as a switch mechanism.

"Black Box" 120 contains electrical circuitry for the device. Alarm indicator 122 associated with and mounted to peripheral housing wall 94 is included in the circuitry through wire 124. The alarm indicator 122 is a buzzer sound compatible with the sound of the chimes, but it will be appreciated, indicator 122 could be a flashing light.

LED 126, also associated with and mounted to housing wall 94, is included in the circuit through wire 128 and visually advises the user of the device that it is in operational condition.

power to box 120 is brought to the chime from an appropriate source (not shown) by line 130 through an outlet box 134 associated with ceiling 16, down, but insulated from, chain **12*b* into housing 96 through opening 136 in housing support top surface 24 to box 120. Box 120 has a 120/9V step down transformer and an A.C./D.C. rectifier. Alternatively, there may be provided a 9V D.C. battery 125 inserted into place through access door 126 in bottom 28**. A 9V D.C. battery can also act as a back-up power supply which cuts in only when line power is terminated.

Chain 140, hanging from housing 96, operates an off switch 142 through line 144 to the electrical circuitry in box 120, chain 140 being as long as need be. It should be appreciated that a remote on/off switch, (not shown), connected to electrical outlet 134 is also contemplated within the invention. In certain circumstances, access to a remote on/off switch is preferred such as when the person using the device is of short stature or security circumstances dictate.

Briefly, the purpose of the alarm chime is to alert a resident or storekeeper of entry and in some cases, unwanted entry. In operation, the chime device is installed above a door 84 with the bulbous pendant end 80 of the striker 76 within the path of the top of the door 84. The striker 76, when moved by an opening door 84, causes disc 64 to move relative to chime tubes 40 and the contact of one or more of the tubes 40 thereby completes an electrical circuit which activates the alarm indicator 122 or like signal indicating means. Intermittent contact of the tubes will activate the alarm indicator 122 intermittently.

Figure 3:
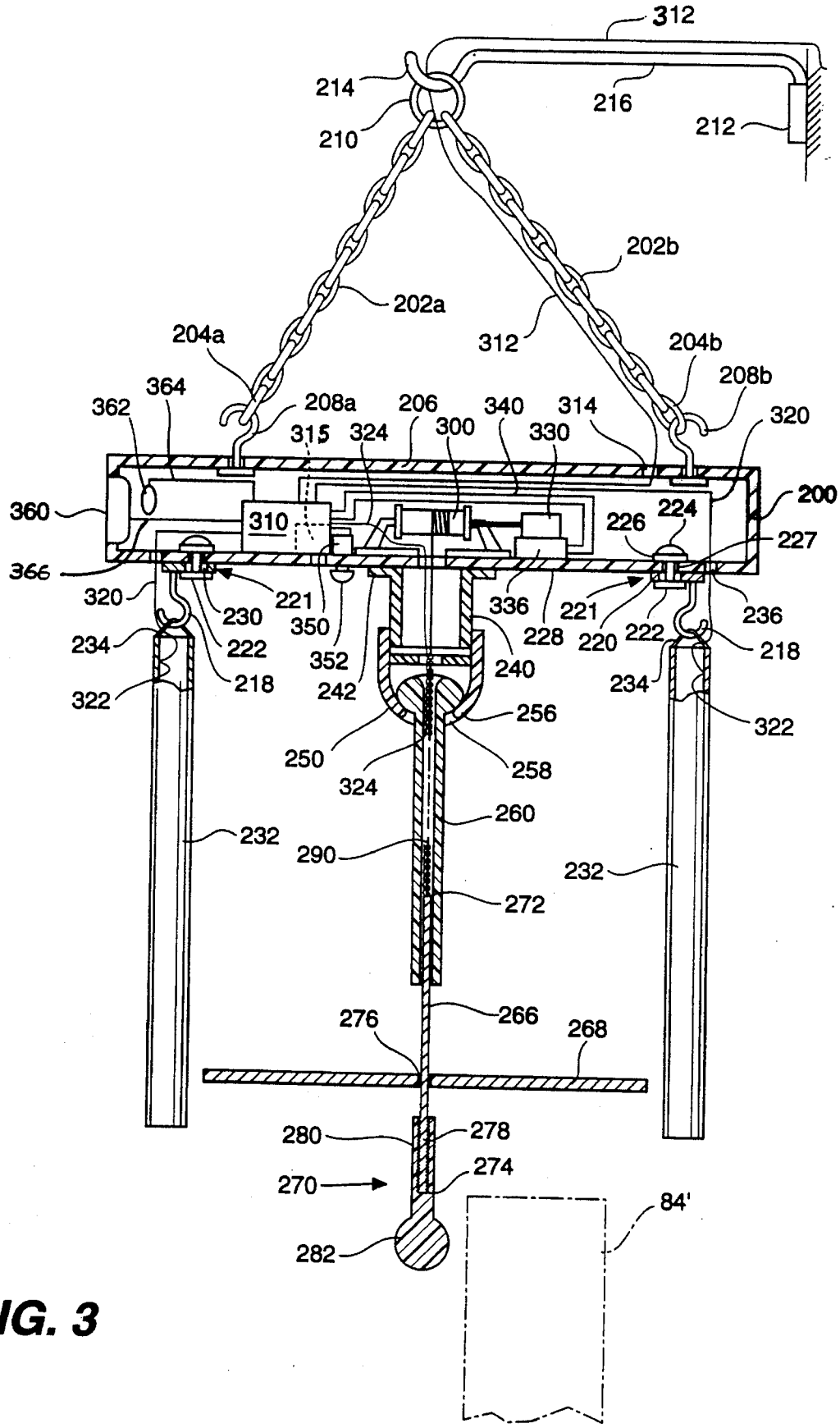
FIG. 3 is an elevational view of a modified embodiment of the chime alarm apparatus.
Figure 4:
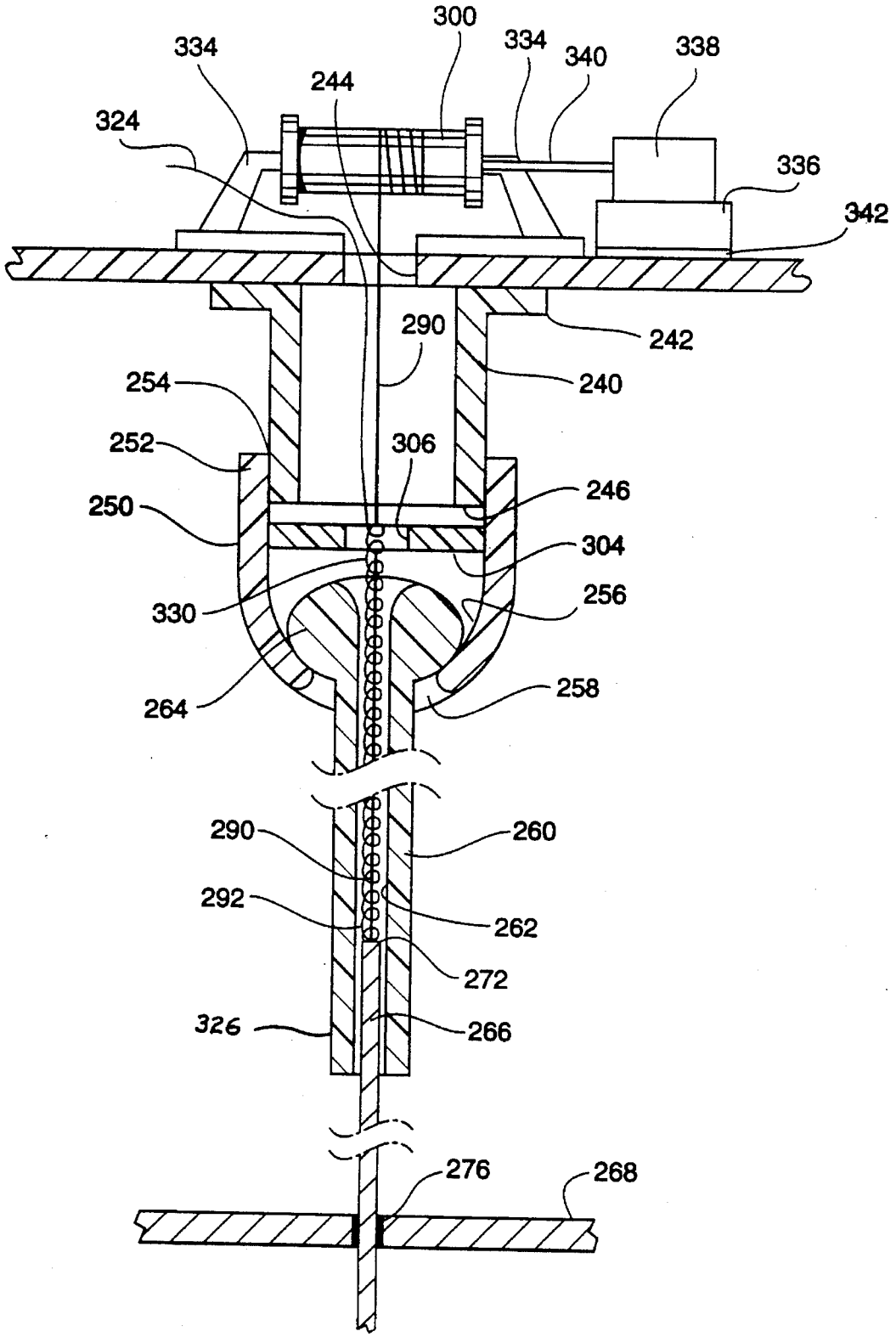
FIG. 4 is an enlarged sectional view of part of the embodiment in FIG. 3.

FIGS. 3 and 4 show a modified embodiment wherein there is provided a drive mechanism for motorized raising or lowering of a striker and the associated door contacting pendant relative to a door.

More particularly, in this modified embodiment shown in FIG. 3, the chime alarm device has cylindrical support housing 200 (shown in cross-section to be of plastic material) supported by four chains 202 similar to those in FIGS. 1 and 2 but only two, **202*a–b*, being shown. The lower ends 204*a–b* of chains 202*a–b* are secured to top 206 of housing 200 via respective hooks 208*a–b*. The upper ends of chains 202*a–b* are detachably associated through ring 210 with support means shown as wall bracket 212, ring 210 being adapted to loop over end 214 of the extended arm 216 of bracket 212**.

Peripherally spaced hooks 218 are each fixedly secured to a slidable block 220 which blocks 220 are each slidably connected to the underside of housing 200 through fastener means 221 comprising of nut 222, bolt 224 and washer 226, fastener means 221 being associated with an aperture 227 in housing bottom 228 and a slot 230 in each block 220.

Each hollow electrically conductive chime tube 232 has eyelet 234 secured to the upper end thereof which eyelet is adapted to cooperate with hook 218. An aperture 236 in housing bottom 228 is laterally adjacent each respective block 220.

First hollow plastic center tube 240, (see also FIG. 4), is secured at its upper end through flange 242 to the bottom 228 of housing 200 about a central aperture 244 therein and has a lower exteriorly threaded end 246. Second hollow plastic tube 250, in the form of a cap, has upper end 252 which is interiorly threaded for threaded connection with first tube end 246 at 254. The interior lower end 256 of second tube 250 is hemispherical in shape with an opening 258 therethrough.

Third plastic tube 260 has a throughbore 262, the upper end 264 thereof being bulbous and adapted to swing or swivel within lower end 256 of second tube 250. The opening 258 of end 256 is of such diameter to permit limited swivelling of third tube 260 relative to the first and second tubes 240 and 250. Third tube 260 is hollow and is adapted to permit telescopic movement therein of electrically conductive support rod 266 for electrically conductive contact disc 268 and non-conductive striker 270. Rod 266 has upper and lower ends 272, 274 respectively, with contact disc 268 secured thereto, intermediate ends 272, 274, by means of welding at 276, although such connection will be a pressfit. The lower end 274 of rod 266 is threadedly secured in bore 278 of striker shank 280 which has lower bulbous end 282.

Non-conductive wire or rope 290 has its lower end 292 secured to upper end 272 of rod 266 and is connected to pulley 300 within housing 200, rope 290 passing through third tube bore 262, second tube 250, first tube 240 and housing aperture 244. As shown more particularly in FIG. 4, peripherally threaded disc 304 with central opening 306 is threadedly located within second tube 250 and is threadedly inserted after bulbous end 264 is located in tube 250 to prevent third tube 260 from moving longitudinally (upwardly) to any extent relative to second and first tubes 250 and 240. However, disc 304 is located in second tube 250 such that swivel or pivoting movement between bulbous end 264 and hemispherical inner end 256 is not restricted.

Within housing 200 is "black box" 310 containing electrical circuitry, box 310 receiving power from an appropriate source (not shown) through line 312 which follows along (or could be within) bracket arm 214, chain 204 and through opening 314 in the top 206 of housing 200 to box 310. Box 310 contains a stepdown transformer (not shown) and 9 volt battery back-up 315 similar to that referred to in the previous embodiment of FIGS. 1 and 2. Wires 320 extend from box 310 through housing aperture 236 to and are secured to the inside of hollow chime tubes 232 at 322. Wire 324 extends from box 310 through aperture 244, down first tube 240, through opening 306 in disc 304, through second tube 250, through bulbous end 264 of third tube 260 and has its lower end 326 secured to upper end 272 of contact disc support tube 266. Accordingly the electric circuitry includes chime tubes 232, rod 266 and disc 276. Wire 324 is preferably lightly helically wrapped about non-conductive wire/rope 290 at 330 so that it does not tangle with rope 290 and has extensibility when rod moves downwardly relative tube 260.

Housing 200 houses pulley 300 rotatably mounted on supports 334, which pulley is controlled through 9 volt reversible d.c. motor 336, appropriate gear reduction device 338 and driveshaft 340, motor 336 being mounted to the bottom of housing 200 at 342. Motor 336 is in electrical connection with circuitry in box 310 through wires 340 and switch 350 is a two pole, three position switch in electrical connection with circuitry in box 310 whereby actuation of button 352 causes operation of motor 336 whereby rope 290 on pulley 300 can raise and lower rod 266 relative to third tube 260 thereby selectively raising and lowering disc 268 and pendant 282 so that the chime/alarm may be selectively deactivated relative to an adjacent door 84'.

Although switch 350 is shown associated with housing 200, it will be appreciated that remote switch actuation for raising and lowering pendant 270 is contemplated.

Alarm indicator and LED power indicator 360, 362 are in electric circuit in box through wires 364 and 366 respectively.

Main power switch 370 is also electrically connected in the circuitry (wires not shown) whereby the alarm/chime may be armed. Switch 370 may also be remotely located as will be appreciated.

The sensitivity of the device shown in FIGS. 3 and 4 may be adjusted by moving blocks 220 outwardly or inwardly relative to housing 200 and center tube 240 through loosening/ securing the nut/bolt fastener means 221. It will be apparent that with conical chime tubes, the movement of rod 266 can be also used to adjust the sensitivity of the apparatus.

Further, it will be appreciated that the weight of the tube elements is significantly lightened when using plastic tubes 240, 252, 260 with wire connection (wire 324) passing through tubes 240, 250 and 260 to disc support rod 266 which is then in electrical circuitry through box 310 with chime tubes 232.

In place of chains 32 and hooks 218, wire can be used which will ensure lateral flexibility and possibly enhance the resonance of the sound caused by the contact between the discs and chime tubes.

Figure 5:
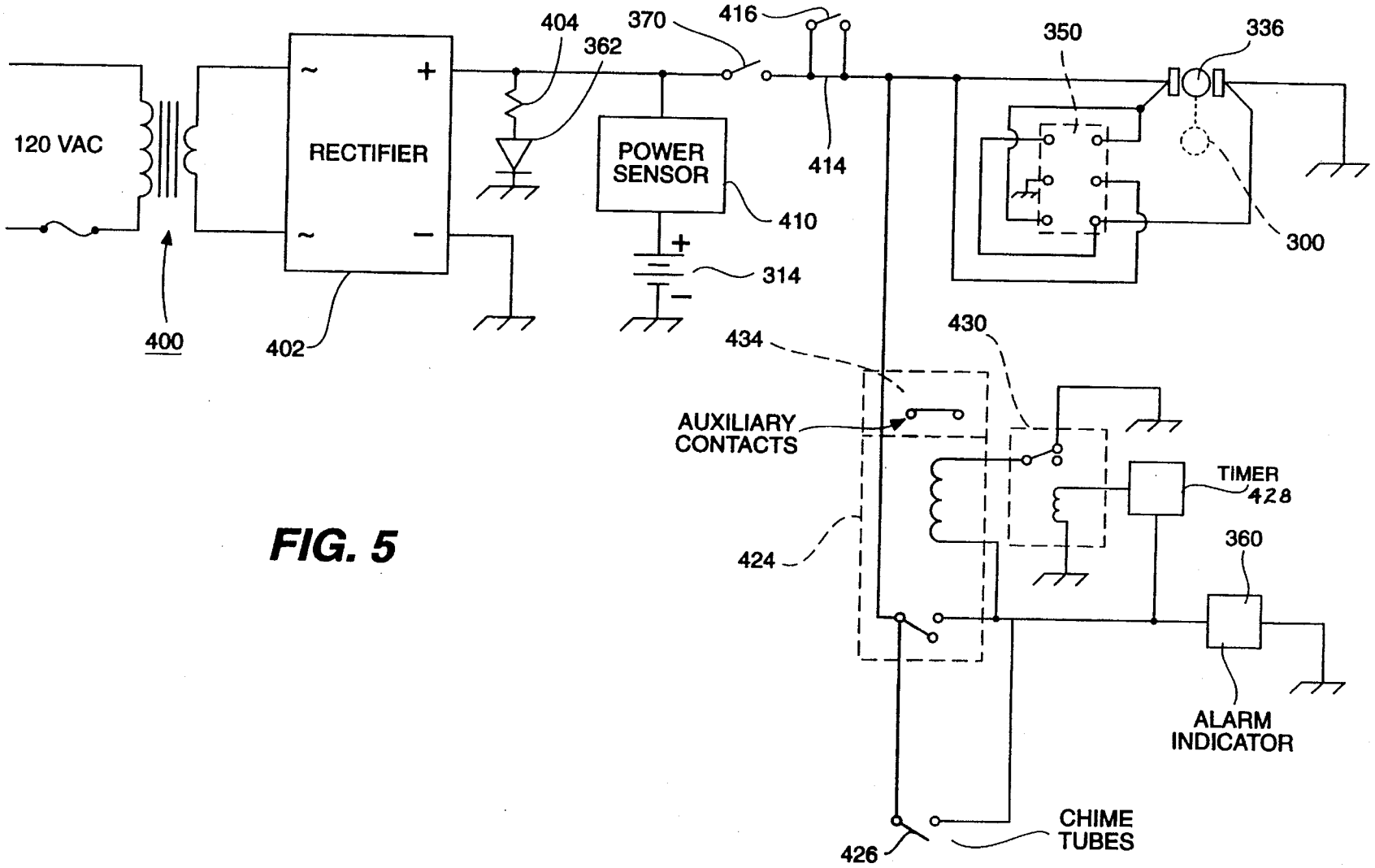
FIG. 5 is a circuit diagram.

FIG. 5 sets forth a simplified but typical electrical circuit for the alarm chime device, particularly referring to the embodiment of FIGS. 3 and 4. Line voltage of 120 V is connected to a stepdown transformer 400 to provide 9 V A.C. to a bridge rectifier 402. A ballast resister 404 and light emitting diode 362 are connected to the positive voltage output to provide visible indication that power is connected to the circuitry. A nine volt backup battery 314 is connected through a power sensor circuit 410 of standard design in order to make the backup battery voltage source 314 available to the circuit should the 120 volt line voltage fail.

A main power switch 370 is provided along with a jumper 414 which may be removed in order to enable a remote activation switch 416 located at a different location to control arming and disarming of the circuit.

A two pole three position switch 350 is provided in order to supply power to reversible DC motor 336 for adjusting the height of the striker 282 through pulley 300 and for turning the reversible motor 336 on and off when in its centre position.

Power is fed to one side of a normally open set of contacts of a solenoid 424. The other side of the normally open set of contacts is connected to the alarm indicator (e.g. buzzer) 360, along with one side of the energizing coil of the solenoid 424. The other side of the energizing coil of solenoid 424 is fed through the normally closed contacts of a second solenoid 430.

Chime switch 426, (that is, contact by disc 268 and a tube 232), is connected in parallel across the normally open set of contacts of solenoid 424. Switch 426 is comprised of the contact formed between disc 268 and chimes 232 which closes electrically whenever the striker is moved causing the disc 268 to come into contact with a chime 232. By this means, power will be fed to the indicator 360 when movement of the door is detected. When this happens, power will also be fed to the coil of solenoid 424, causing the normally open contacts to close and providing power to the coil of solenoid 424 directly through the contacts, bypassing switch 426. Solenoid 424 is thus caused to lock in the on position. At the same time, power is fed to a timer circuit 428 of any conventional design, which is set to deactivate the energizing coil of solenoid 430 after a predetermined period of time. When this happens, the normally closed contacts of solenoid 430 are opened, causing the energizing current of solenoid 424 to be interrupted, thereby breaking the power to the indicator 360 and resetting the system.

Auxiliary contacts 434 are associated with the main holding coil 424 to enable the chime device to be tied into or associated with other alarm systems or to activate other devices which may be at a different location.

Still further, it will be apparent that the circuitry may include a fuse means wherein a button (not shown) on the housing enables reset of the circuit.

Further still, it will also be apparent that the chime alarm device may be adapted for use with windows which open inwardly.

The embodiments of the invention in which an exclusive property or privilege is claimed are defined as follows:

1. Chime alarm apparatus comprising:

a housing having an axis;

means for suspending said housing from rigid support means;

elongate support means for supporting a disc-shaped contact member, said support means having upper and lower ends, means for suspending said elongate support means at its upper end from said housing and substantially coaxially therewith, whereby said elongate support means may swing laterally relative to said housing, said disc-shaped contact member supported by said elongate support means intermediate the ends thereof, said lower end of said elongate support means including pendant means whereby the elongate support means may be caused to move laterally by an external force contacting said pendant means;

a plurality of chime members each having upper and lower ends and being suspended from said housing peripherally outwardly of, and spaced a selected distance from, said elongate support means and said disc-shaped contact member, each said chime member having an area of electrical contact between its ends, said pendant means being normally below the lower ends of said second members;

said disc-shaped contact member and said chime members being of a material whereby a chime sound is produced when the contact member moves laterally and contacts the area of contact of at least one of said chime members;

an electric circuit including in said circuit, a source of power, said disc-shaped contact member, said area of electrical contact of at least one of said chime members and including an alarm means separate from said chime members, whereby when said disc-shaped contact member contacts said area of contact of said least one chime member, the electric circuit is closed and said alarm means in the electric circuit is activated.

2. The apparatus of claim 1 wherein said elongate support means includes means for adjusting the length thereof whereby the position of said pendant means relative to the external force may be selected.

3. The apparatus of claim 2 wherein the chime members are conical in longitudinal configuration and adjusting the length of said elongate support member raises or lowers the contact member relative to said chime members whereby said selected space between said disc-shaped contact members and said chime members can be selectively increased or decreased to define sensitivity of the alarm apparatus to actuation by said external force coacting with said pendant.

4. The apparatus of claim 1 further including means for adjusting said selected distance between said chime members and said disc-shaped contact member whereby sensitivity of the alarm apparatus to actuation may be selected;

said chime members being conical in configuration and said adjusting means including a threaded connection between said disc-shaped contact member and said elongate support means whereby selected rotation of said disc-shaped contact member relative to said elongate support means adjusts said selected distance between said disc-shaped contact member and said chime members.

5. Chime alarm apparatus comprising:

a housing having an axis;

means for suspending said housing from rigid support means;

elongate support means for supporting a disc-shaped contact member, said support means having upper and lower ends, means for suspending said elongate support means at its upper end from said housing and substantially coaxially therewith, whereby said elongate support means may swing laterally relative to said housing, said disc-shaped contact member supported by said elongate support means intermediate the ends thereof, said lower end of said elongate support means including pendant means whereby the elongate support means may be caused to move laterally by an external force contacting said pendant means;

a plurality of chime members each having upper and lower ends and being suspended from said housing peripherally outwardly of and spaced a selected distance from, said elongate support means and said disc-shaped contact member, each said chime member having an area of electrical contact between its ends, said pendant means being normally below the lower ends of said second members;

said disc-shaped contact member and said chime members being of a material whereby a chime sound is produced when the contact member moves laterally and contacts the area of contact of at least one of said chime members;

an electric circuit including in said circuit, a source of power, said disc-shaped contact member, said area of electrical contact of at least one of said chime members and including an alarm means separate from said chime members, whereby when said disc-shaped contact member contacts said area of contact of said least one chime member, the electric circuit is closed and said alarm means in the electric circuit is activated;

said elongate support means including telescoping annular elements and further comprising means for adjusting the relative longitudinal position of said telescoping elements, whereby the length of said elongate support means may be selectively adjusted, said adjusting means including motor means in said housing and connected in said electrical circuit, said adjusting means including means functionally connecting said motor means to one of said telescopic elements, and switch means for selectively operating said motor means whereby said motor means is selectively operable to move said pendant means longitudinally relative to said chime members and out of contact with said external force.

6. The apparatus of claim 5 wherein said telescoping annular elements includes a first hollow annular member, a second hollow annular member and third hollow annular member, said first hollow annular member being secured centrally at its upper end to a lower surface of said housing and said second hollow annular member threadedly secured at its upper end to the lower end of said first hollow annular member, the lower end of said second hollow annular member being internally hemispherical in shape and having an opening, the upper end of said third hollow annular means being bulbous and being adapted to be held within said lower end of said second hollow annular member for limited universal movement therewith, said telescoping elements further including a fourth tubular member having an upper portion telescopingly received with respect to a lower portion of said third hollow annular member, said fourth tubular member supporting said disc-shaped contact member, said adjusting means including a pulley operationally connected with said motor means and wire means extending from said pulley through said first, second and third hollow annular members and secured to the upper end of said fourth tubular member, whereby at least a portion of said fourth tubular member is adapted to telescope with respect to said third hollow annular member.

* * * * *